US007341098B2

(12) United States Patent
Brost et al.

(10) Patent No.: US 7,341,098 B2
(45) Date of Patent: Mar. 11, 2008

(54) HEAT EXCHANGER AND METHOD OF PRODUCING

(75) Inventors: Viktor Brost, Aichtal (DE); Rainer Käsinger, Haiterbach (DE); Denis Bazika, Esslingen (DE)

(73) Assignee: Modine Manufacturing Company, Racine, WI (US)

( * ) Notice: Subject to any disclaimer, the term of this patent is extended or adjusted under 35 U.S.C. 154(b) by 130 days.

(21) Appl. No.: 11/355,857

(22) Filed: Feb. 15, 2006

(65) Prior Publication Data

US 2006/0185833 A1 Aug. 24, 2006

(30) Foreign Application Priority Data

Feb. 24, 2005 (DE) ..... 10 2005 008 409

(51) Int. Cl.
*F28D 1/053* (2006.01)

(52) U.S. Cl. ..... 165/149; 29/890.052; 165/153

(58) Field of Classification Search ..... 165/148, 165/149, 152, 153, 173, 175; 29/890.052, 29/890.03

See application file for complete search history.

(56) References Cited

U.S. PATENT DOCUMENTS 4,531,578 A * 7/1985 Stay et al. ..... 165/175
5,195,579 A * 3/1993 Buchanan ..... 165/149
5,219,024 A * 6/1993 Potier ..... 165/173
5,311,933 A * 5/1994 Lee ..... 165/149
5,758,721 A * 6/1998 Letrange et al. ..... 165/173
6,296,051 B1 * 10/2001 Sahnoun et al. ..... 165/173
2002/0023734 A1 * 2/2002 Wagner ..... 165/81
2003/0006028 A1 * 1/2003 Kalbacher ..... 165/173

FOREIGN PATENT DOCUMENTS

EP 1 273 864 * 1/2003
FR 2 742 528 * 6/1997

* cited by examiner

*Primary Examiner*—Teresa J. Walberg
(74) *Attorney, Agent, or Firm*—Michael Best & Friedrich LLP

(57) ABSTRACT

A heat exchanger including a collecting tank having an outwardly extending flange around an edge, a tube plate having a connection edge, tubes having ends extending into openings in the tube plate, and an intermediate plate having an edge lying against the connection edge of the tube plate. The connection edges of the intermediate plate and the tube plate are both mechanically connected to the flange of the collecting tank. Pins in the corners of one of the tube plate and the intermediate plate secure the tube plate and intermediate plate together. The connection edge of the plates include protrusions bendable onto the edge flange of the collecting tank.

12 Claims, 5 Drawing Sheets

HEAT EXCHANGER AND METHOD OF PRODUCING

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to heat exchangers, and more particularly to heat exchangers having tubes secured to a tube plate connected along its edge to a collecting tank, and a method of producing such heat exchanger.

BACKGROUND OF THE INVENTION AND TECHNICAL PROBLEMS POSED BY THE PRIOR ART

Heat exchangers having tubes and ribs forming a core, in which a first medium (e.g., coolant) flows through the tubes and a second medium (e.g., environmental air) passes over the ribs for heat exchange between the two media are well known. Also well known are the use of collecting tanks with such cores, where the collecting tanks are secured to the ends of the tubes to distribute medium flow to the tubes (at the inlet end) and collect medium from the tubes (at the outlet end).

Such heat exchangers have been subjected to a variety of design alternatives intended to address a variety of concerns and issues. For example, minimizing materials is a desirable goal in the manufacture of most heat exchangers (e.g., to minimize costs), and is particularly so with vehicular heat exchangers where component weight is an important consideration. As another example, EP 1 273 864 A2 discloses a heat exchanger in which an intermediate plate is provided so that a heat exchanger with cooling grates of different depths may be made at a relatively low modification cost. However, it has been found that, in such structures, the reduction in materials (and related reduction in sheet thickness) can result in a heat exchanger in which the connection and holding forces may not be sufficient to withstand the increasing pressures and other loads to which the heat exchanger may be subjected.

The present invention is directed toward overcoming one or more of the problems set forth above.

SUMMARY OF THE INVENTION

In one aspect of the present invention, a heat exchanger is providing including a collecting tank having an outwardly extending flange around an edge, a tube plate having a connection edge, tubes having ends extending into openings in the tube plate, and an intermediate plate having an edge lying against the connection edge of the tube plate. The connection edges of the intermediate plate and the tube plate are both mechanically connected to the flange of the collecting tank.

In one form of this aspect of the present invention, the intermediate plate lies in the tube plate.

In another form of this aspect of the present invention, the tube plate lies in the intermediate plate.

In still another form of this aspect of the present invention, pins are in the corners of one of the tube plate and the intermediate plate, and the pins secure the tube plate and intermediate plate together.

In yet another form of this aspect of the present invention, the connection edge of the intermediate plate and the connection edge of the tube plate comprise of a plurality of protrusions bendable onto the edge flange of the collecting tank. In a further form, beads are provided in the protrusions.

In a further form of this aspect of the present invention, indentations are provided in the connection edges of the intermediate plate and the tube plate, with the indentations generally parallel to the plane of tube plate deformable inward onto the tank flange to define a generally wave-like trend of the connection edges. In one further form, the indentations are congruent relative to each other on the connection edges. In another further form, the indentations are offset relative to each other on the connection edges.

In another form of this aspect of the present invention, perforations are provided in the connection edges of at least one of the tube plate and the intermediate plate, and protrusions on the tank edge flange are received in the perforations.

In another aspect of the present invention, a method of producing a heat exchanger is provided, including the steps of (a) assembling a heat exchanger core of the flat tubes and ribs, (b) mounting a tube plate and an intermediate plate on the ends of the flat tubes, (c) metallically joining the tubes, ribs, tube plate and intermediate plate into a unit, and (d) mechanically connecting a collecting tank to the tube plate and the intermediate plate by deforming both of the tube and intermediate plates.

In one form of this aspect of the present invention, the tube plate and the intermediate plate are deformed simultaneously in the mechanically connecting step.

DETAILED DESCRIPTION OF THE INVENTION

The present invention relates to a heat exchanger 20, for example, a charge air cooler or a coolant radiator, situated in a vehicle. For simplicity of illustration, the collecting tank 22 on only one side of the heat exchanger 20 is illustrated, though it should be understood that the other side may be identical at least in terms of the design of interest here. As is understood by those skilled in the art, cooling air usually flows through heat exchanger ribs 26, for example corrugated ribs, removing heat from the other medium which flows in tubes 28 via a collecting tank 22. As is understood by those skilled in the art, the ribs 26 and tubes 28 may be advantageously assembled to form a heat exchanger core during assembly of the heat exchanger 20

Figure 1:
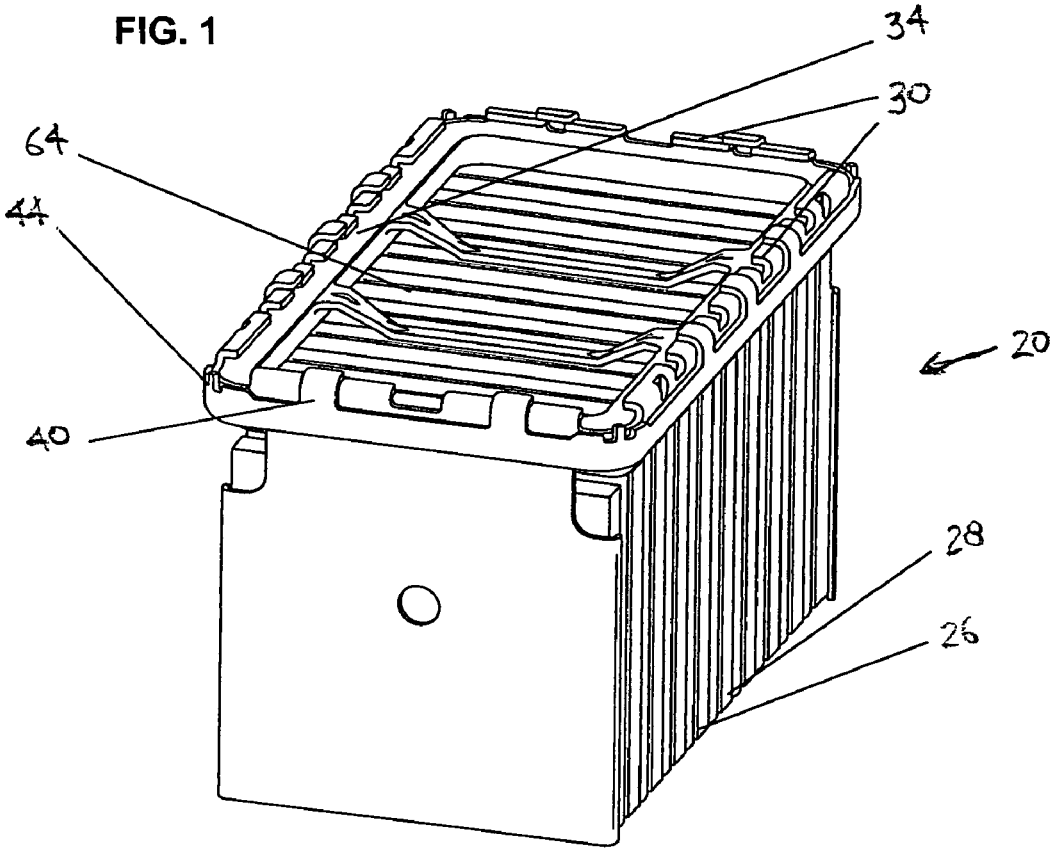
FIG. 1 is a perspective view of a partially produced heat exchanger according to the present invention.

The heat exchanger 20 depicted in FIG. 1 is situated, in principle, in the state in which it is present after leaving a soldering furnace. In this condition, the connection edge 30 on the intermediate plate 34 and the connection edge 40 on the tube plate 44 are already deformed. Initially, however, the edges 30 and 40 are almost vertical relative to the plane of tube plate 44, whereby the collecting tank 22 may be positioned on the plates 34, 44 as described below, with the edges 30, 40 only acquiring the bent shape depicted in FIG. 1 after positioning and mechanical connection of the collecting tank 22 (see FIG. 4).

After insertion of a suitable seal (not shown) and mounting of the collecting tank 22, both the parts (tabs) of the edge 30 of the intermediate plate 34 and the parts of the tube plate edge 40 may be advantageously deformed in a machine tool so that, in this practical example, they are bent downward onto the outwardly projecting flange or bulge 50 around the edge of the collecting tank 22, so that the edges 30, 40 of both the intermediate plate 34 and the tube plate 44 together serve to hold the collecting tank 22 thereon. Bending deformation of both plates 34, 44 may advantageously be accomplished simultaneously.

In the depicted practical example, the intermediate plate 34 lies in tube plate 44, with the edge 54 of intermediate plate 34 lying inside the connection edge 40 of tube plate 44, and may be advantageously soldered therein. It should be appreciated that the components may advantageously be aluminum such as is generally known in the art.

The depicted intermediate plate 34 has two transverse struts 60. The struts 60, and are positioned so as to each lie between two tube openings 64 in the tube plate 44. The struts 60 may be advantageously soldered to the tube plate 44 between tube openings 64.

Figure 2:
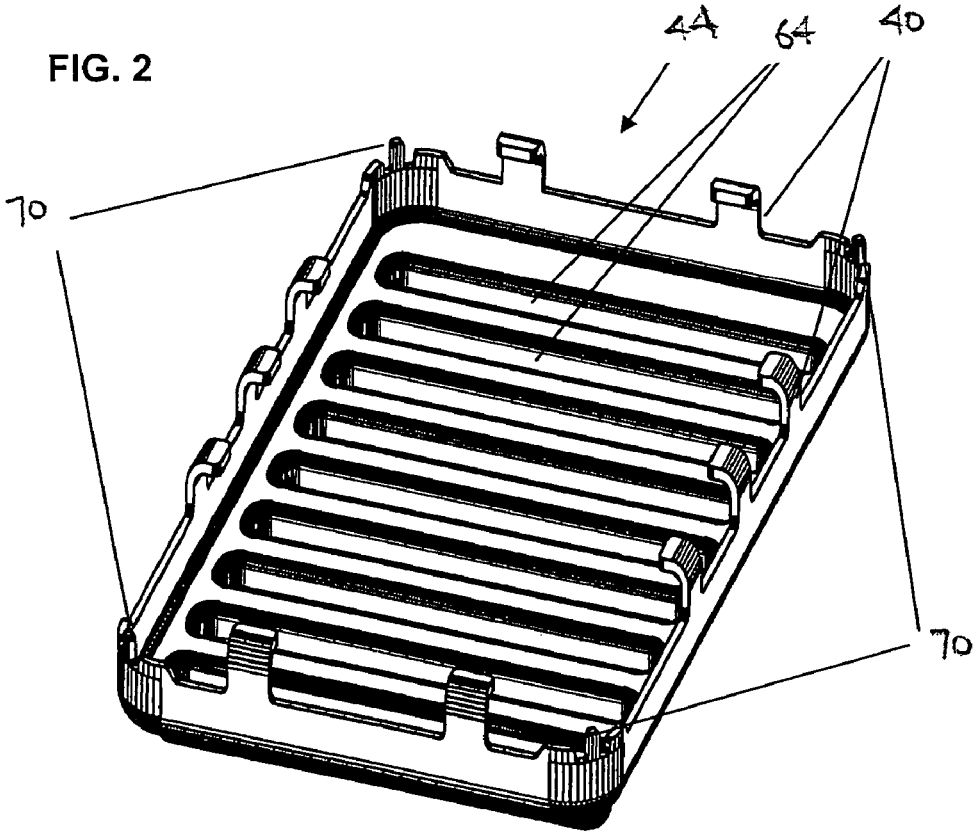
FIG. 2 is a perspective view of the tube plate of FIG. 1.
Figure 3:
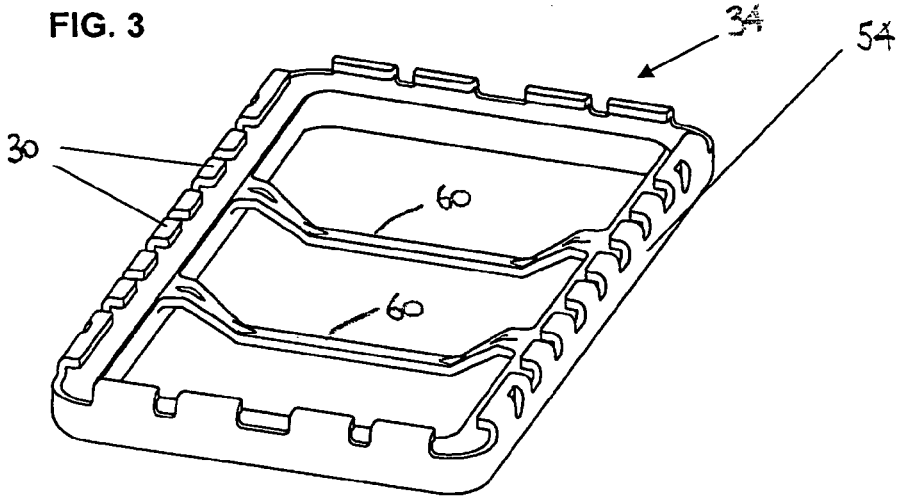
FIG. 3 is a perspective view of the intermediate plate of FIG. 1.

FIG. 2 shows a tube plate 44 as used in the illustrated practical example, and FIG. 3 shows an intermediate plate 34 from the same perspective. Since, as already mentioned, the intermediate plate 34 lies in the tube plate 44 in this practical example, the tabs on the connection edge 40 of tube plate 44 are somewhat longer than the tabs on the connection edge 30 of intermediate plate 34, as can easily be seen from a comparison of FIGS. 2 and 3, whereby both sets of tabs may readily clamp onto the flange 50 of the collecting tank 22. Further, the numbers, size and arrangement of tabs on both edges 40, 30 may be different, as also can easily be seen from a comparison of FIGS. 2 and 3.

Figure 4:
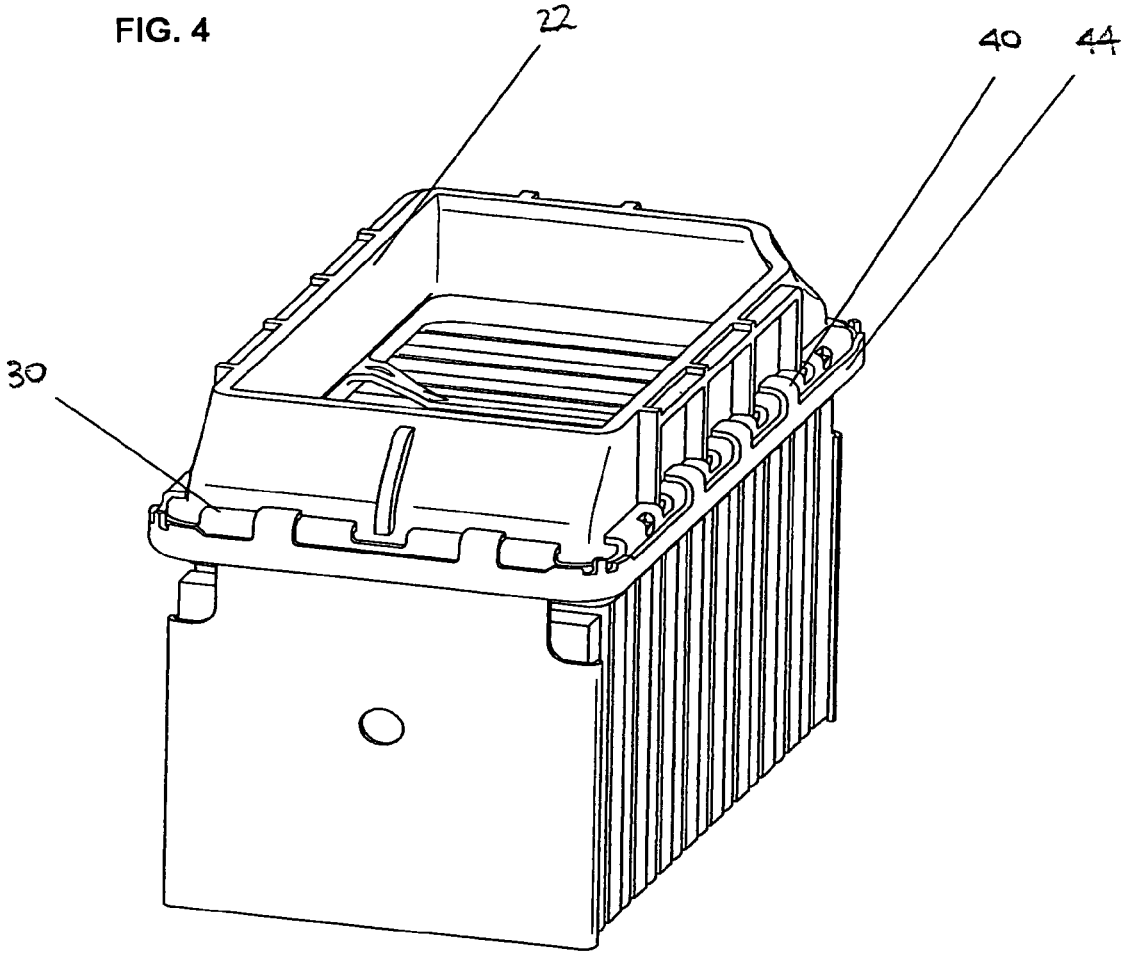
FIG. 4 is a perspective view similar to FIG. 1, but showing a collecting tank installed thereon.
Figure 5:
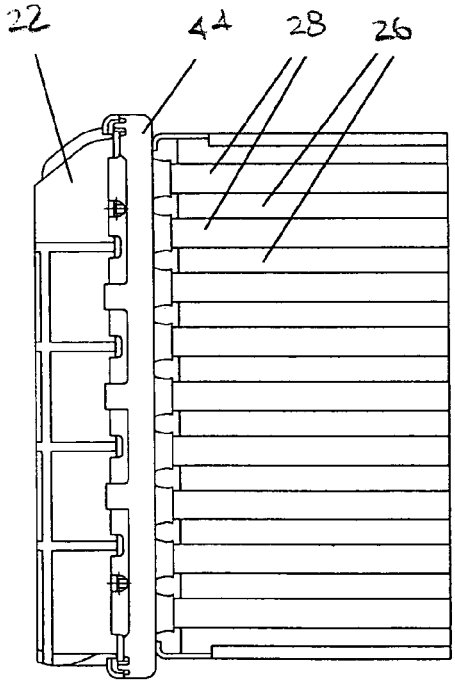
FIG. 5 is a side view of the assembly of FIG. 4.

The tabs on both edges 40, 30 lie one above the other in the depicted practical example, as can be clearly seen from FIGS. 1 and 4.

It should therefore be appreciated that there is latitude in terms of different configurations for such tabs for different practical examples. For example, it can be advantageous to deform the tabs successively rather than simultaneously (e.g., initially the tabs of the tube plate 44 may be deformed (preferably in one working step), and then the tabs of intermediate plate 34 (also in one working step), or vice versa, with the tabs of the intermediate plate 34 first deformed and then the tabs of the tube plate 44.

Figure 6:
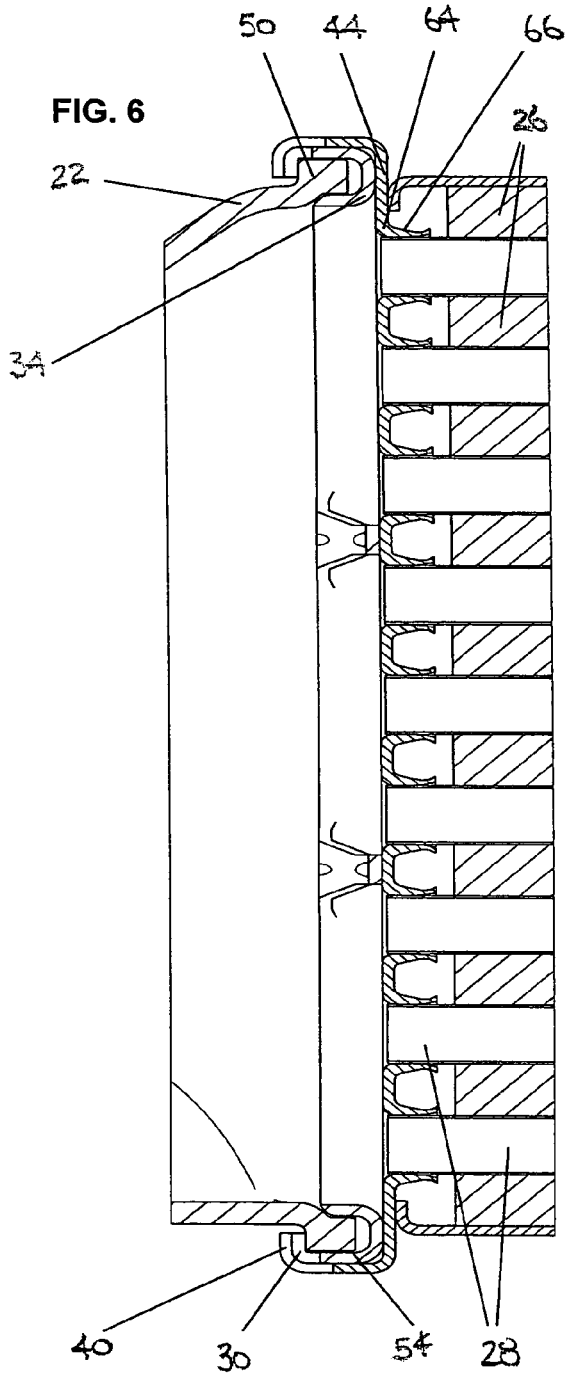
FIG. 6 is a longitudinal cross-sectional view through the heat exchanger of FIGS. 1-5.

Additional aspects of the present invention are depicted in FIG. 6. For example, it is apparent from the longitudinal section through the heat exchanger 20 that the tube openings 64 in the tube plate 44 are equipped with particularly long passages 66 reduced in thickness, which are directed toward ribs 26. The ends of the tubes 28 are soldered to the passages of 66 and do not extend beyond the internal tube plate surface. This design is favorable because the pressure loss is kept low on this account.

Figure 7:
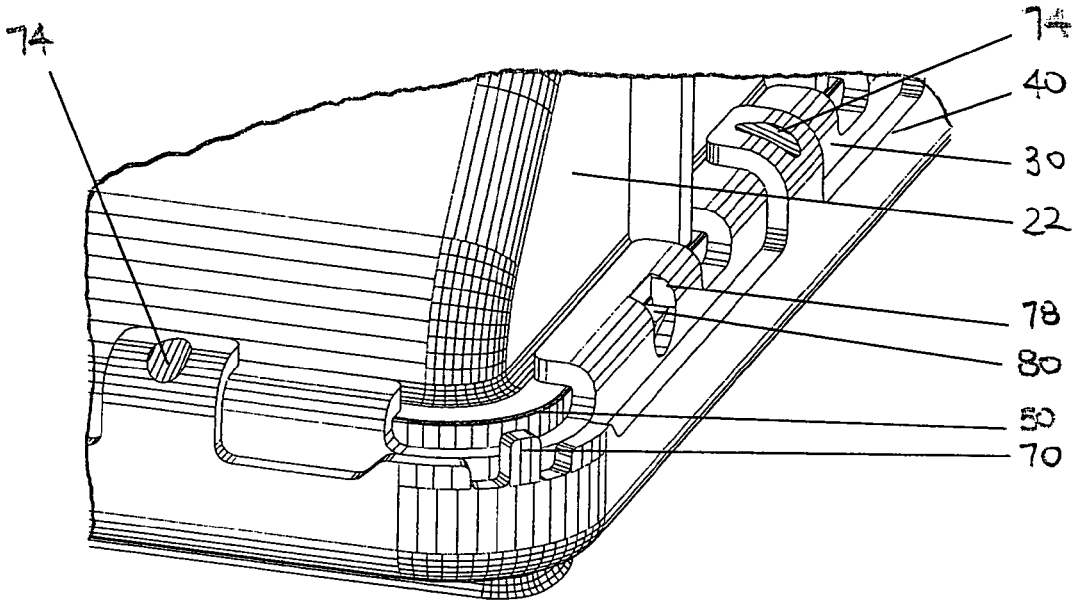
FIG. 7 is a perspective view of a portion of the assembly showing a detailed view of clamping of the plates and collecting tank.

FIGS. 2 and 7 show pins 70 in the corners of the tube plate 44, which pins 70 serve to pre-fasten the intermediate plate 34 to the tube plate. Beads 74 can be formed in the tabs to improve rigidity and holding properties. Perforations 78 are also provided in the intermediate plate 34 into which protrusions 80 molded on the edge bulge 50 of the collecting tank 22 engage in order to secure the collecting tank 22 before its mechanical connection by the tabs, and also to force it firmly onto the seal (not shown).

Figure 8:
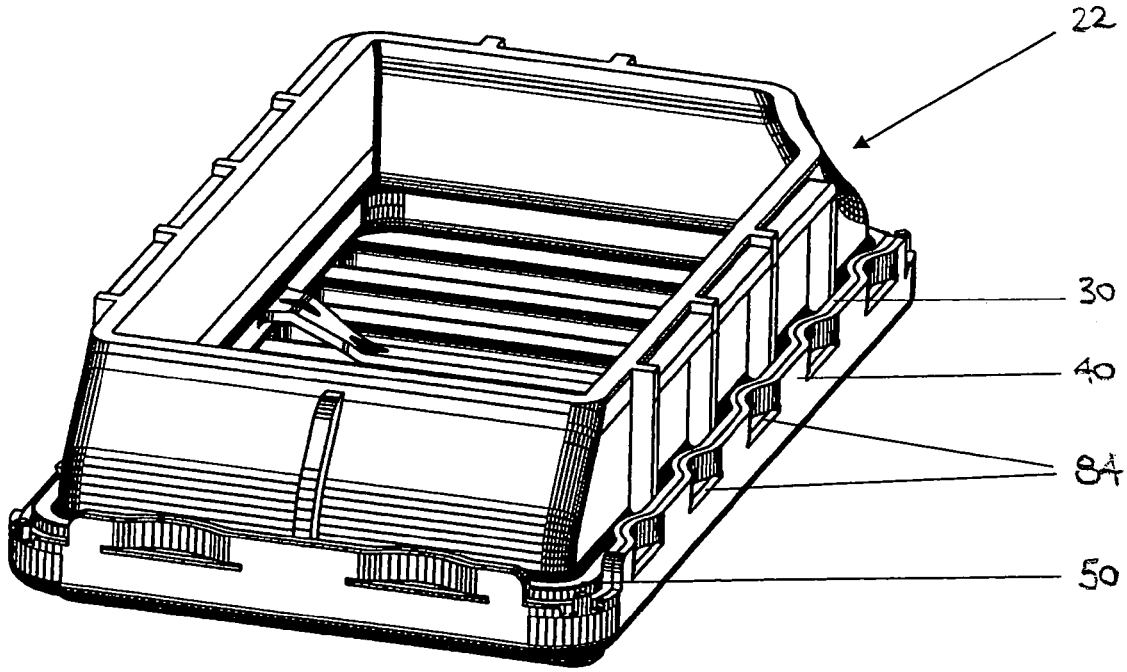
FIG. 8 is a perspective view illustrating the connection of a collecting tank to tube and intermediate plates according to a second embodiment of the present invention.
Figure 9:
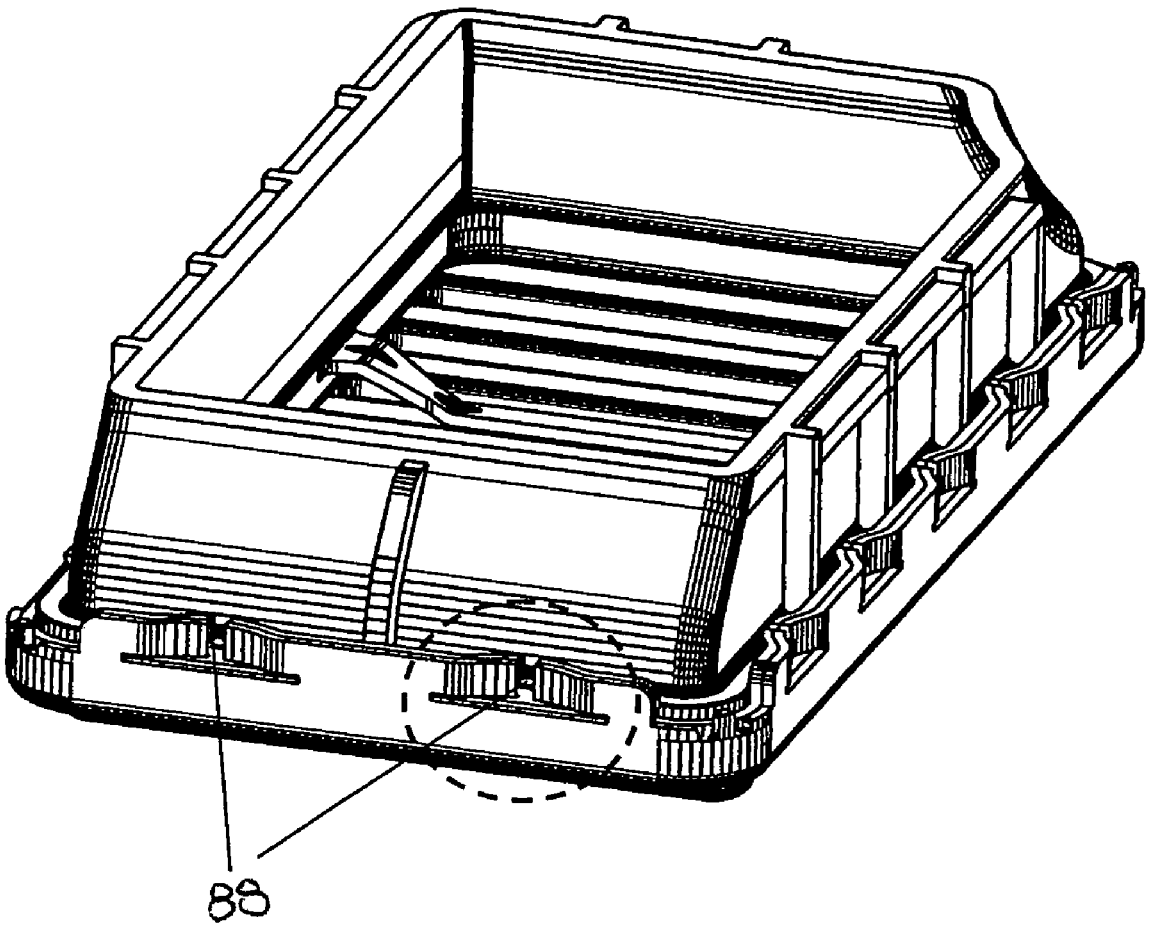
FIG. 9 is a perspective view of a variation of the FIG. 8 embodiment.

FIGS. 8 and 9 show different variants with a corrugated trend on the connection edges 40 and 30. The sections deformed on the edge bulge 50 of the collecting tank 22 in FIG. 9 are divided (see reference number 88) perpendicular above the indentations 84 of the connection edges. In both Figures, the trend of the corrugations (indentations 84) on the connection edge of intermediate plate 34 is congruent with the trend of the corrugations on the connection edge of tube plate 44.

It should thus be appreciated that the disclosed invention provides an excellent compromise between low material use and an increase in connection strength. The intermediate plate 34 is an additional component, but one of relatively limited weight, since only a frame-like part is involved. Because of the "doubled" connection (by which is meant both a connection in which protruding tabs or similar parts of the edge of the tube plate and similar parts of the intermediate plate lie one above the other, and also those in which the mentioned parts lie next to each other), a way to further reduce sheet thickness of the tube plate 44 has been demonstrated in which the connection and holding forces are guaranteed despite the limited sheet thickness of the tube plate 44. Heat exchangers 20 can also be provided in which the protrusion of the tube plate 44 beyond the periphery of the tubes 28 is relatively small. A compact arrangement of the heat exchanger, for example in a heat exchanger module, is therefore possible, in which several heat exchangers can be arranged one against the other.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A heat exchanger, comprising:

a collecting tank having an outwardly extending flange around an edge;

a tube plate having a connection edge;

tubes having ends extending into openings in said tube plate; and an intermediate plate having a connection edge lying against the connection edge of said tube plate;

wherein said connection edges of said intermediate plate and said tube plate are both mechanically connected to the flange of said collecting tank.

2. The heat exchanger of claim 1, wherein the intermediate plate lies in the tube plate.

3. The heat exchanger of claim 1, wherein the tube plate lies in the intermediate plate.

4. The heat exchanger of claim 1, further comprising pins in the corners of one of said tube plate and said intermediate plate, said pins securing said tube plate and intermediate plate together.

5. The heat exchanger of claim 1, wherein the connection edge of the intermediate plate and the connection edge of the tube plate comprise of a plurality of protrusions bendable onto the edge flange of the collecting tank.

6. The heat exchanger of claim 5, further comprising beads in said protrusions.

7. The heat exchanger of claim 1, further comprising indentations in the connection edges of said intermediate plate and said tube plate, said indentations generally parallel to the plane of tube plate deformable inward onto the tank flange to define a generally wave-like trend of the connection edges.

8. The heat exchanger of claim 7, wherein said indentations are congruent relative to each other on the connection edges.

9. The heat exchanger of claim 7, wherein said indentations are offset relative to each other on the connection edges.

10. The heat exchanger of claim 1, further comprising:

perforations in the connection edges of at least one of said tube plate and said intermediate plate; and protrusions on the tank edge flange received in said perforations.

11. A method of producing a heat exchanger, comprising the steps of:

assembling a heat exchanger core of flat tubes and ribs;

mounting a tube plate and an intermediate plate on the ends of said flat tubes;

metallically joining said tubes, ribs, tube plate and intermediate plate into a unit;

mechanically connecting a collecting tank to said tube plate and said intermediate plate by deforming both of said tube and intermediate plates.

12. The method of claim 11, wherein said tube plate and said intermediate plate are deformed simultaneously in said mechanically connecting step.

* * * * *